US005884904A

United States Patent [19]

Martini

[11] Patent Number: 5,884,904

[45] Date of Patent: Mar. 23, 1999

[54] CORNER JIG AND METHOD OF USING

[76] Inventor: Donald Martini, 141 Rte. 94, Blairstown, N.J. 07825

[21] Appl. No.: 985,710

[22] Filed: Dec. 5, 1997

[51] Int. Cl.[6] ..... B25B 1/20

[52] U.S. Cl. ..... 269/41; 269/45

[58] Field of Search ..... 269/41, 45, 99, 269/44

[56] References Cited

U.S. PATENT DOCUMENTS

| | | | |
|---|---|---|---|
| 600,370 | 3/1898 | Kohler . | |
| 683,184 | 9/1901 | Rockwell . | |
| 744,559 | 11/1903 | Kendrick | 269/45 |
| 2,461,733 | 2/1949 | Stark . | |
| 2,761,476 | 9/1956 | Gunas . | |
| 2,835,978 | 5/1958 | Krisel . | |
| 2,991,070 | 4/1961 | Overton | 269/45 |
| 3,363,377 | 1/1968 | Beckman . | |
| 3,914,871 | 10/1975 | Wolff . | |
| 4,138,819 | 2/1979 | Sosin . | |
| 4,209,164 | 6/1980 | Brothers . | |
| 4,300,754 | 11/1981 | Lawrence . | |
| 4,361,964 | 12/1982 | Hennessee . | |
| 4,881,726 | 11/1989 | Jolkovski | 269/41 |
| 5,360,212 | 11/1994 | West . | |
| 5,456,015 | 10/1995 | Butcher et al. . | |
| 5,573,228 | 11/1996 | Chestnut | 269/41 |

*Primary Examiner*—David A. Scherbel
*Assistant Examiner*—Lee Wilson
*Attorney, Agent, or Firm*—Charles A. Wilkinson; Harris A. Wolin

[57] ABSTRACT

A support structure to aid in the creation of a corner joint between two planar perpendicularly-situated workpieces. The support structure of the invention consists primarily of a horizontal and vertical support surface, with the vertical support surface displaced from the horizontal surface and separated therefrom by a clearance area, such clearance area designed to accommodate excess material present at the formation of the corner joint between the two workpieces. The support structure of the invention may be used to create a single corner joint, or a second support structure may be implemented in conjunction with the first support structure to simultaneously create multiple corner joints. A variety of clamping and fastening implements are disclosed to maintain the workpieces attached to the support structure.

20 Claims, 10 Drawing Sheets

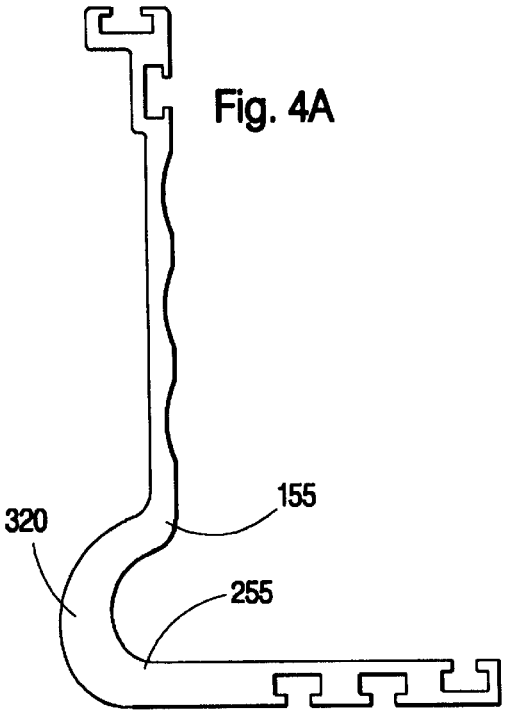
Fig. 4A
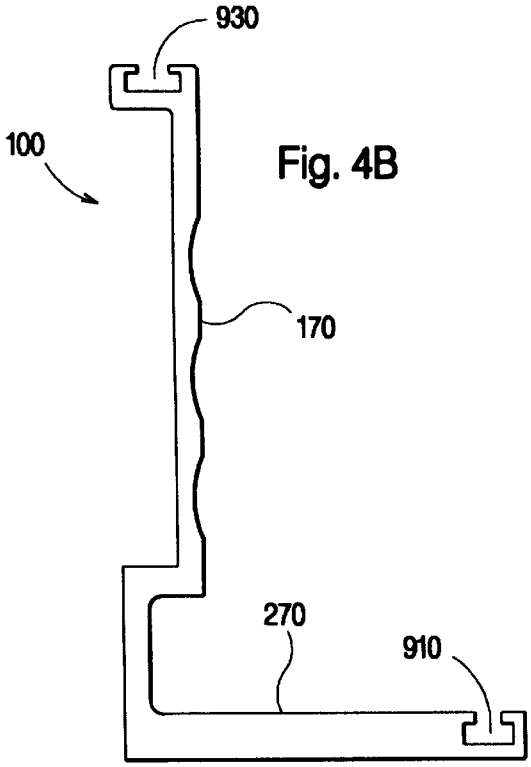
Fig. 4B
Fig. 5
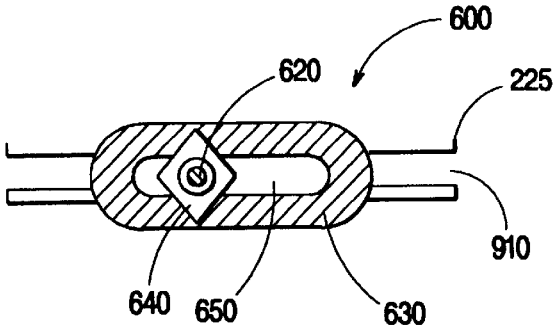
Fig. 6
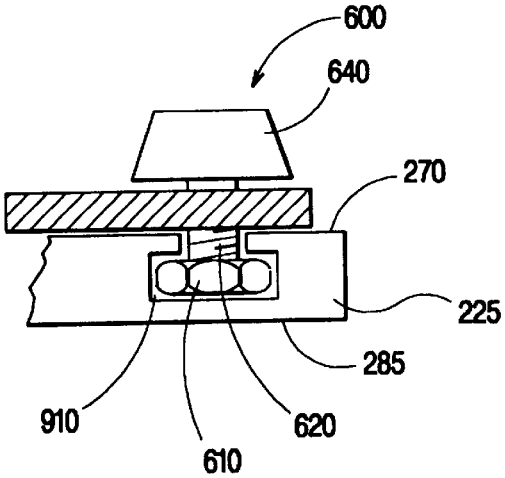

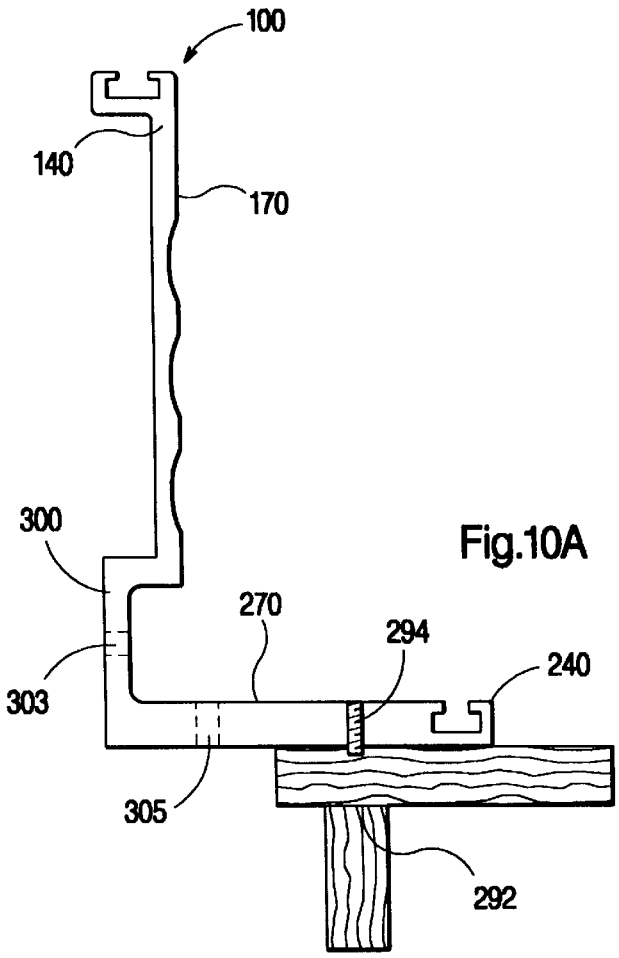
Fig.10A
Fig. 12
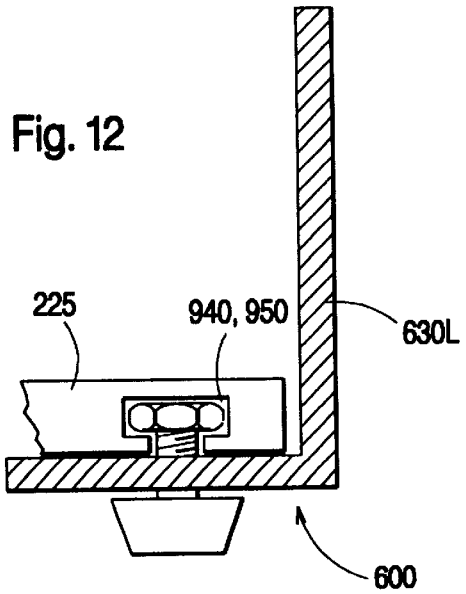
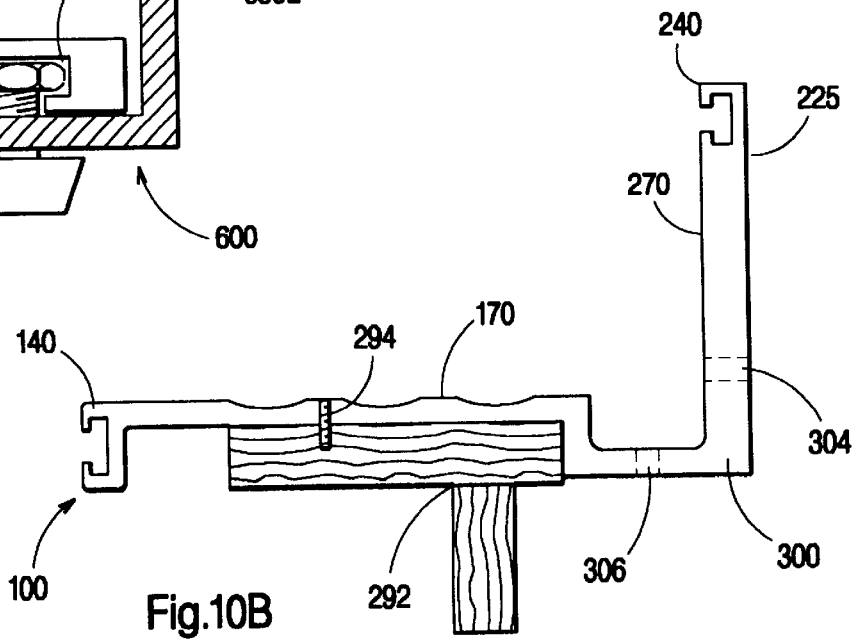
Fig.10B

CORNER JIG AND METHOD OF USING

BACKGROUND OF THE INVENTION

1. Field of the Invention

The present invention relates generally to jigs for use in the woodworking industry, and more particularly, to a multi-purpose jig which provides a right-angle foundation against which two workpieces may be clamped and joined together to form an exact corner joint between the two workpieces.

2. Preliminary Discussion

Carpenters, woodworkers and the like comprise some of the most creative minds when it comes to problem solving. There is a reason these people are often associated with the term "handyman," or "handywoman" as the case may be, since they often strive to find the easiest and most efficient way to do things. Woodworkers, in general, are always creating specialized tools, devices, gadgets, and such, to fulfill a specific need, or meet a specific condition.

A "jig", defined as a device for guiding a tool or for holding machine work in place, carries a much broader connotation in the woodworking industry. Often characterized as a handyman's helper, it provides a user with the ability to produce results not ordinarily accomplished by hand, such as, for example, using a power saw to make a perfect 45° cut. Jigs are primarily used or thought of as work holders, either holding the workpiece in a semi-permanent fastening arrangement, or temporarily guiding the workpiece as it is operated or worked upon, usually by the use of a saw, lathe or the like.

Holding multiple planar objects in a 90° relationship to each other, whether it be to produce a simple two-piece corner, or a four-walled box structure, often involves the implementation of multiple clamping structures and multiple clamping surfaces to accommodate both the workpieces and such clamping structures. Prior art structures that have been developed to aid in the fastening together of multiple planar objects are generally more complicated than they need to be. Multiple clamps, as well as multiple clamp holders, are usually necessary to effectuate a proper hold, and this may require a fair amount of manipulation on the part of the user, as well as a fair amount of working space needed to accommodate such devices.

The creation of a corner joint between two planar workpieces requires a certain amount of skill, not only in the placement of the support members, but in the actual preparation and design of the workpieces which results in the corner joint. Slapping two pieces of wood together with some glue and a couple of screws may be enough for the novice carpenter. The experienced craftsman, however, often demands a greater attention to detail, and the production of a "clean" corner joint, especially when producing cabinetry and the like, is a true art form. The objective in producing a clean corner joint is to create the appearance of a single continuous piece with a single grain, and not to have an obvious seam indicating the junction of two dissimilar pieces. One way to produce a clean corner joint is to cut a "seat" in one piece, into which the other piece will be glued into place, such that, if the objects are pieces of wood, the surface grains of the two pieces will meet at the corner, as opposed to the edge grains, so that once the corner is finished off, it will appear like one continuous grain piece. The creation of the "seat" is done by slicing out a strip along the edge of the first joined piece, and housing the edge of the second piece against such strip with some glue therebetween, such that the edge of the second piece is hidden by the strip of the first piece. This "housing" often results in a surplus of material extending beyond the location where the second piece is introduced, which surplus is then removed and the corner joint is subsequently finished and polished. Consequently, when two perpendicularly-situated planar objects are fastened together at a 90° angle in this fashion, there is a need to not only provide the actual perpendicular support, but to accommodate the initial surplus of material extending from one of the pieces when forming a joint of this type. A corner joint of this quality usually involves multiple support surfaces and multiple clamping arrangements upon such support surfaces.

The present inventor, who has been intimately associated with the use of various supporting and clamping devices, has ascertained a need, and has designed a simple device, which easily, efficiently and in an uncomplicated manner, provides the support structure to produce quality corner joints with the least amount of tools. The present inventor has consolidated and reduced the unwieldy concepts underlying the prior art devices into a one-piece support device which is superior to the prior art in both function and form. The simplicity and effectiveness of the device of the present invention readily distinguishes it from the prior art.

3. Description of Related Art

The clamping and securing art, and more particularly, the devices or tools used to achieve planar 90° corners, has followed or undergone an interesting evolution. The joining together of perpendicularly-oriented planar objects in a secured fashion often involves the necessity for the use of multiple tools, usually one to support the horizontal object, one to support the vertical object, and another device to maintain such objects in a secured arrangement. The prior art is, in fact, replete with clamps, vices, angles, "T"-squares and the like. However, there is no device which addresses the particular concerns of the present inventor, that is, to provide a simple device with which to produce quality corner joints.

The evolution of such clamping and securing devices has exhibited a relatively static or slow progression, and the present state of the art is not that far removed from those devices patented around the turn of the century. One of the earliest two-dimensional joining devices is disclosed in U.S. Pat. No. 600,370 issued to A. Kohler on Mar. 8, 1898 entitled "Miter Clamp." The Kohler reference discloses a more or less conventional miter clamp, which is used to aid in securing two ends of mitered molding in place during the fastening process. The Kohler reference demonstrates a device which is used to join two perpendicularly positioned pieces of material extending along the same plane using a pair of clamps integrated along the device. A miter clamp is functional when creating a corner joint from two similarly-situated planar objects as disclosed by the Kohler reference. However, such clamp is non-functional when such planar objects are not similarly-situated, i.e. are perpendicular (90°) or at some other angle along an extended joint. A three-dimensional joint often requires a more sophisticated tool or instrument which is capable of providing the necessary support along all such dimensions.

U.S. Pat. No. 683,184 issued to J. P. Rockwell on Sep. 24, 1901 entitled "Clamp", discloses a four-member clamp with adjusting screws in all four directions and provides for a variety of fastening and clamping applications. This particular reference addresses multi-dimensional clamping, and illustrates some of the basic concepts that underlie the most sophisticated clamping devices of today. The Rockwell device utilizes the compression of multi-dimensional oppositely-driven vice members connected by screw means to create the necessary support. Contemporary clamps all follow a similar basic principle, with the only real difference being in the manufacture of the housing for the clamping and screw-driven elements. Whether it be a "C" clamp, bar clamp, or the like, the necessary elements are nearly always the same, i.e. a pair of oppositely-situated compression members, a track or support upon which such compression members move, and means by which such members are brought together or extended apart.

Clamping devices and the like will only work if the support surface is amenable to the workpieces, or the objects to be clamped and/or joined together. For example, clamps to aid in the creation of a 90° corner joint between two perpendicular planar objects must be provided with a perpendicular foundation, or the clamps will lack the necessary support to maintain the perpendicular relationship. U.S. Pat. No. 2,461,733 issued Feb. 15, 1949 to C. J. Stark entitled "Gauge for Collocating Pipe Sections," is an example of a perpendicular support specifically designed to accommodate a particularly shaped workpiece. The Stark reference shows a pipe flange gauge with an offset in the gauge to accommodate the side extensions of such pipe flange. The Stark arrangement for providing a three-dimensional perpendicular support illustrates a desirable feature for such device, namely an offset portion to accommodate the flange of a pipe coupling. Such offset portion is two-dimensional rather than three-dimensional as in the present applicant's invention, where an extended intersection between two right angularly connected guide members is an integral feature to the device, and such offset distinguishes both the Stark device and the device of the present invention from a mere 90° angled support structure (an angle plate). The three-dimensional offset feature of the jig device of the present invention is designed specifically to accommodate an extension or surplus of material usually found on one of the two perpendicularly-situated planar objects that are to be joined together to form a corner joint.

U.S. Pat. No. 2,761,476 issued to P. J. Gunas on Sep. 4, 1956 entitled "Adjustable Corner Clamp", discloses a conventional corner clamp adjustable along its base to accommodate varying workpiece widths. The Gunas reference is more akin to the previously discussed Kohler reference, than to the device of the present invention, since it joins two workpieces along a miter cut arrangement and operates in a single dimensional plane.

A perpendicular angle plate is shown in U.S. Pat. No. 2,835,978 issued to F. Krisel on May 27, 1958 entitled "Double Face Angle and Set Up Plate." The Krisel reference discloses an angle plate with handles, forming a perfect 90° angle with a variety of applications. The walls of the plate are raised to accommodate exterior fixation means, such as clamps, and a cylindrical clearance recess is provided where the interior walls meet. The Krisel device is in essence a mere angle plate with means for easily toting such plate, and the cylindrical recess formed between the two plates does not approach the function of the recess area provided in the device of the present invention. Even if the Krisel apparatus were to be implemented in the creation of corner joints in the field of cabinetry and the like, the clearance recess of the Krisel device would not provide the necessary space to accommodate the overhang of a glued corner joint.

U.S. Pat. No. 3,363,377 issued to M. H. Beckman on Jan. 16, 1968 entitled "Metal Intersection Stud", discloses a connection device for interior and partition walls, such device being used to join two corners together in a parallel arrangement. The channel section of the Beckman device maintains a first wall section in perpendicular arrangement with a second wall section, with such wall sections positioned to permanently overlap in order to fit within the stud and to provide enhanced stability at the corner joint. Two recessed sections are opposed in the Beckman arrangement to provide a reinforced overlapping intersection joint. The recess area in the device of the present invention, on the other hand, is provided to accommodate and reinforce a temporary overlap of two joined workpieces, which need not fill the offset as in Beckman, and therefore, there is no functional similarity between the device of the present invention and the Beckman device, and the only structural similarity is the cross-sectional shape of one side of the Beckman design.

U.S. Pat. No. 3,914,871 issued to R. Wolff on Oct. 28, 1975 entitled "Doweling Boring Gauge for Two Workpieces to be Dowelled Together on Their Front Flat Sides", discloses an alignment clamp system for the creation of boring holes along the corner of two joined workpieces into which will be placed dowel connections. The clamping system maintains the two workpieces in a perpendicular arrangement while the holes are drilled into the workpieces, with one clamp being longitudinally moveable along the length of the corner while the other clamp is fixed to a workbench, table or the like, and the resulting workpieces may be joined to form a corner with precise dowel connections. The device of the present invention is a corner joint facilitator, while the Wolff device is a corner joint preparer and does not actually assist in the joinder of the two perpendicularly situated workpieces. Wolff does have a similar offset arrangement on his clamps to accommodate overlaps on two intersecting sections of a corner joint.

U.S. Pat. No. 4,138,819 issued to G. J. Sosin on Feb. 13, 1979 entitled "Outside Corner Square", discloses a corner square with a clearance area for irregular, non-smooth corner joints. The measurement and squaring of outside corners requires a device with a similar recess area to accommodate such outside corners and the like, and therefore, the cross sectional design between the Sosin square and the device of the present invention are somewhat similar. The Sosin design employs a recess area in the vertical and horizontal planar directions. However, the preferred device of the present invention requires a recess area in only one planar direction. The Sosin device is essentially constructed as a two-dimensional device while the device of the present invention is essentially a three-dimensional device. The functions of the two-dimensional Sosin measurement device and the planar three-dimensional support device of the present invention are also completely different.

U.S. Pat. No. 4,209,164 issued to A. O. Brothers on Jun. 24, 1980 entitled "Tool for Use in Constructing Paneled Ornaments", discloses an angled jig for the connection of three-dimensional workpieces at obtuse angles. The Brothers reference does not demonstrate a clearance area to accommodate an irregular corner or an overhang or excess material, although it does demonstrate the joinder of planar workpieces at an adjustable angle.

U.S. Pat. No. 4,300,754 issued to B. N. Lawrence on Nov. 17, 1981 entitled "Welding Clamp", discloses a clamp for maintaining an angle member in a perpendicular relationship with a flat plate upon which the angle member is to be welded. The Lawrence clamp could not be used to form a corner joint in the same manner as the device of the present invention between a vertically and horizontally situated workpiece because the Lawrence clamp assumes that the workpiece is already in the form of an angle, and therefore, does not provide the proper support to accomplish such task. The Lawrence clamp also does not provide a recess area, which is critical to the formation of such joints.

U.S. Pat. No. 4,361,964 issued to J. W. Hennessee on Dec. 7, 1982 entitled "Lay Out Square", discloses a folding square for laying out the location of tees and corners as shown in the figures of the reference patent. The Hennessee reference demonstrates a conventional square device and does not provide a clearance area as previously mentioned and discussed.

One of the most recent devices designed to position angularly situated workpieces is U.S. Pat. No. 5,360,212 issued to J. West on Nov. 1, 1994 entitled "Jointing Jig." The West reference discloses a hinged jig with angularly positioned channels for the placement and connection of a variety of angularly situated beam-like workpieces. The West reference does not provide elongated planar support surfaces necessary for the joining of planar workpieces in a corner relationship, as provided for in, and is necessary with, the device of the present invention.

Another recent device, U.S. Pat. No. 5,456,015 issued to R. L. Butcher on Oct. 10, 1995 entitled "Construction Framing Square", discloses a device which is similar in design to the previously mentioned Hennessee '964 reference, and this being so, is only similar to the device of the present invention in its profile, not function. The Butcher reference could not accommodate a corner joint situation since it lacks the clearance area necessary to form a corner joint.

Design U.S. Pat. No. 346,225 issued to J. C. Bancroft on Apr. 19, 1994, entitled "Exterior Trim," discloses an extruded exterior trim section having a recess at the intersection of two right angularly related flanges. The section is designed for use as exterior trim rather than a jig or tool and, in any event, the two flanges are not precisely at right angles, so the device could not be used in the same manner as applicant's device.

The prior art has yet to exhibit a handyman's tool which will facilitate the efficient creation of a smooth, accurate corner joint, in the demandingly accurate manner prescribed and expected by a skilled craftsman. The present inventor, frustrated by such a deficiency in the prior art, has recognized a need to fill this void, for both the benefit of himself and those skilled in the art. The prior art devices in the clamp, jig, and vice classifications have been fairly static in functional evolution over the years, with their mechanical operation changing only slightly. The one-piece support device of the present invention is, however, so simplistic, in light of the large number of prior art devices which have merely grown more complicated over time without a proportional increase in efficiency of function, that one skilled in the art will readily recognize such innovation as being clearly unobvious in the art particularly in light of the trend toward complexity in the art. The novel jig device of the invention is in fact of such increased efficiency in the facilitation of the production of neat, accurate corner joints as to be a major advance in the art.

OBJECTS OF THE INVENTION

It is an object of the present invention, therefore, to provide a device which will support multiple planar objects in a perpendicular, fastenable relationship.

It is a further object of the present invention to provide a device which will clampingly support multiple planar objects in either a perpendicular or parallel relationship.

It is a still further object of the present invention to provide a device which will support two planar objects in a perpendicular relationship at their respective ends in order to form a corner joint therebetween.

It is a still further object of the present invention to provide a device which comprises a clearance area to accommodate any excess material present during the creation of a typical corner joint.

It is a still further object of the present invention to provide a device which allows for quick and easy clamping of a planar workpiece to the support surface of the device of the invention.

It is a still further object of the present invention to provide a device which comprises integrated clamping and fastening elements designed into the workpiece, such that external clamping components become unnecessary in order to fasten the workpieces to the device of the invention.

It is a still further object of the present invention to provide a device with multiple working surfaces each serving a variety of purposes.

It is a still further object of the present invention to provide a device which may be implemented or used by itself, or in conjunction with other devices of a similar nature.

It is a still further object of the present invention to provide a device which may be implemented in oppositely oriented pairs to provide for the simultaneous creation of a pair of joints at opposite ends of a workpiece constrained within the device of the invention.

It is a still further object of the present invention to provide a device which comprises a one-piece construction, and is therefore structurally uncomplicated and easy to produce.

It is a still further object of the present invention to provide a device which is unintrusive during use, easy to operate and implement, and easy to transport and store.

Still other objects and advantages of the invention will become clear upon review of the following detailed description in conjunction with the appended drawings.

SUMMARY OF THE INVENTION

The device of the present invention comprises a one-piece extrusion with multiple support surfaces for the support and temporary constraint of one or more planar workpieces. The device of the invention is generally "L" shaped, and primarily comprises a horizontal and vertical support surface, with the vertical support surface displaced from the horizontal surface and separated therefrom by what is defined as a clearance area. The clearance area is appropriately termed because the corner section of the horizontal support surface, or the location defined by the heel of the "L" shaped device, being extended beyond the plane defining the vertical support surface, has the ability to accommodate any material from the horizontal workpiece extending beyond the intersection with the vertical workpiece, which frequently occurs during the creation of a corner joint between two planar workpieces in woodworking. The geometry of the clearance area, while accommodating horizontal workpiece extensions, defines additional support surfaces on the opposite sides of the primary support surfaces of the device of the invention for the performance of parallel fastening arrangements.

The planar support surfaces of the device of the present invention are designed to easily accommodate external clamping implements to maintain the workpieces against such support surfaces. In an alternative embodiment of the device of the invention, longitudinal grooves or slots may be provided along the support surfaces of the device of the invention in various places to house or accommodate special fastening implements therein, thereby possibly alleviating the need to use external clamping implements.

BRIEF DESCRIPTION OF THE DRAWINGS

FIG. 4A is an end view of an alternative embodiment of the corner jig device of the present invention showing a single curved connecting member as opposed to a right angle connecting member.

FIG. 4B is an end view of an alternative embodiment of the corner jig device of the present invention showing a reduced number of slots.

FIG. 5 is a top view of a slot-positioned fastening implement shown within a partial top view of a slot.

FIG. 6 is a side view of a slot-positioned fastening implement shown within a partial top view of a slot.

FIG. 10A is an side view of the jig device of the invention shown supported by or fastened to a table.

FIG. 10B is an side view of the jig device of the invention positioned in an alternative orientation shown supported by or fastened to a table.

FIG. 12 is a side view of a slot-positioned fastening implement shown within a partial side view of a slot, with a "L" shaped cam-fastening member for extension above the surface of the second planar member of the device of the invention.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
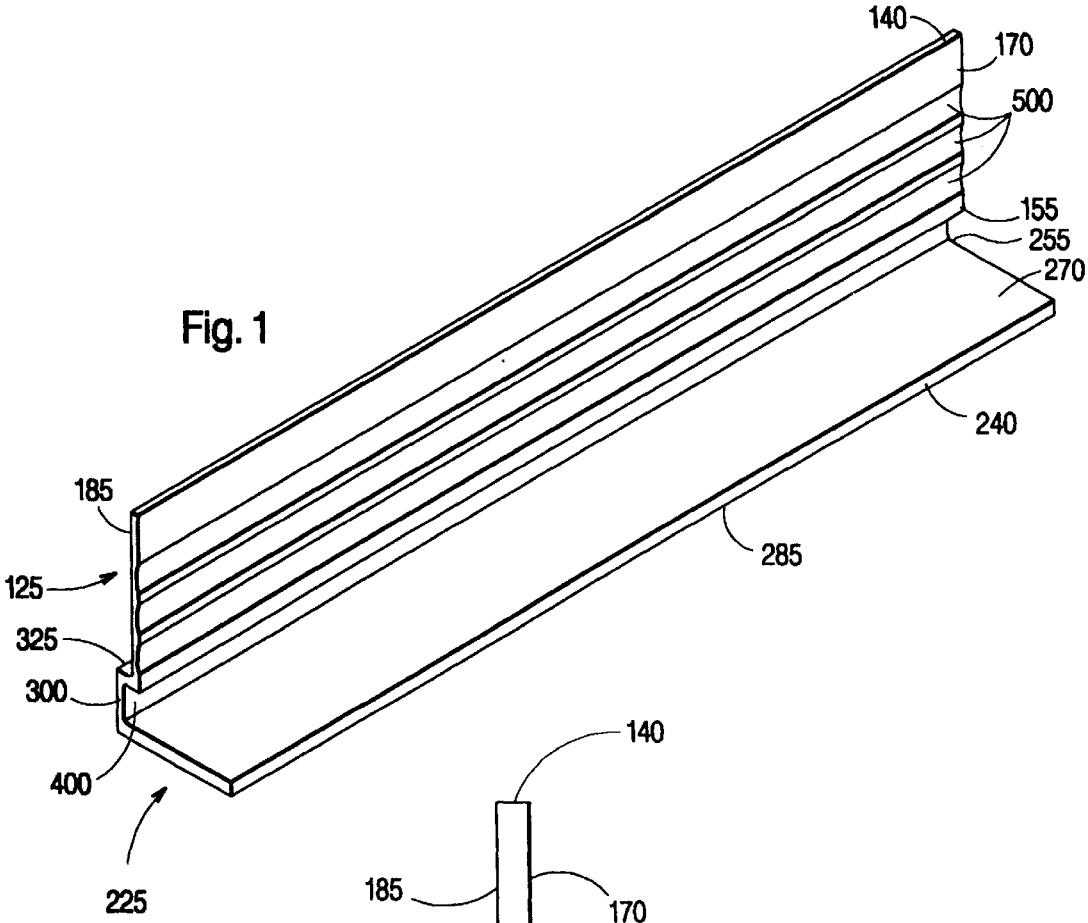
FIG. 1 is an isometric view of a broad or basic embodiment of the corner jig device of the present invention.
Figure 2:
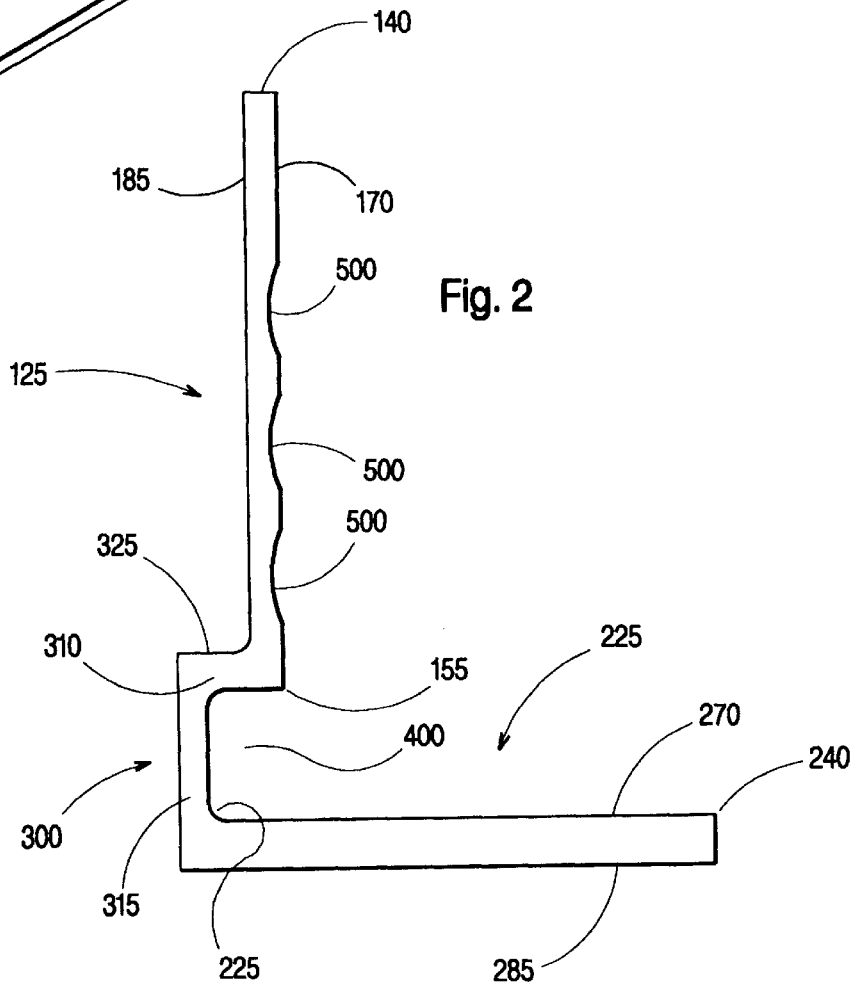
FIG. 2 is an enlarged end view of the broad or basic embodiment of the corner jig device of the present invention shown in FIG. 1.

FIG. 1 is an isometric view and FIG. 2 is an end view of a broad or basic embodiment of the corner jig device 100 of the present invention. The jig 100 comprises a first substantially planar member 125 with an upper terminus 140, a lower terminus 155, a primary support surface 170, and a secondary support surface 185. A second substantially planar member 225 comprises a front terminus 240, a rear terminus 255, a primary support surface 270 and a secondary support surface 285. A connecting member 300 extends between the lower terminus 155 of the first planar member 125 and the rear terminus 255 of the second planar member 225, defining a tertiary support surface 325 adjacent the secondary surface 185 of the first planar member 125 and substantially parallel to the second planar member 225. The area bounded by the connecting member 300, the rear terminus 255 of the second planar member 225, and the lower terminus 155 of the first planar member 125 defines a recess 400. The recess 400 also defines the displacement between the first and second planar members 125 and 225 respectively. It is preferable to have the first and second planar members 125 and 225 respectively be at a right angle (90°), such that any workpieces (shown later) supported against the surfaces 170 and 270 for purposes of, for example, forming a corner joint will also be positioned at a right angle. If it should be the case that the first and second planar members 125 and 225, or the first and second surfaces 170 and 270, do not form a right angle, most likely due to a flaw in the manufacturing or extrusion process, then a shim (shown in FIG. 7) of any suitable dimensions and geometry may be inserted in between the workpiece and one or both of the surfaces 170 and/or 270.

Shallow grooves or scalloped indentations 500 located along the primary surface 170 of the first planar member 125 may extend the length of the first planar member 125 as shown, or may similarly extend the length of the secondary planar member 225 (such groove not being shown in FIGS. 1 and 2), or may extend along both the first and second planar members (both not shown), or may not be present at all (again not shown) on the device of the invention. These grooves 500 aid in reducing the manufacturing cost by reducing the actual amount of material present within the device of the invention, without sacrificing the planar surface or surfaces 170 and/or 270. As may be better seen in FIG. 2, the primary surface 170 of the first planar member 125 is substantially flat, and assuming the introduction of a planar workpiece (not shown) against the surface 170, the shallow grooves or scalloped indentations 500 would not impair the intersection or contact between the workpiece (not shown) and the surface 170.

Figure 3:
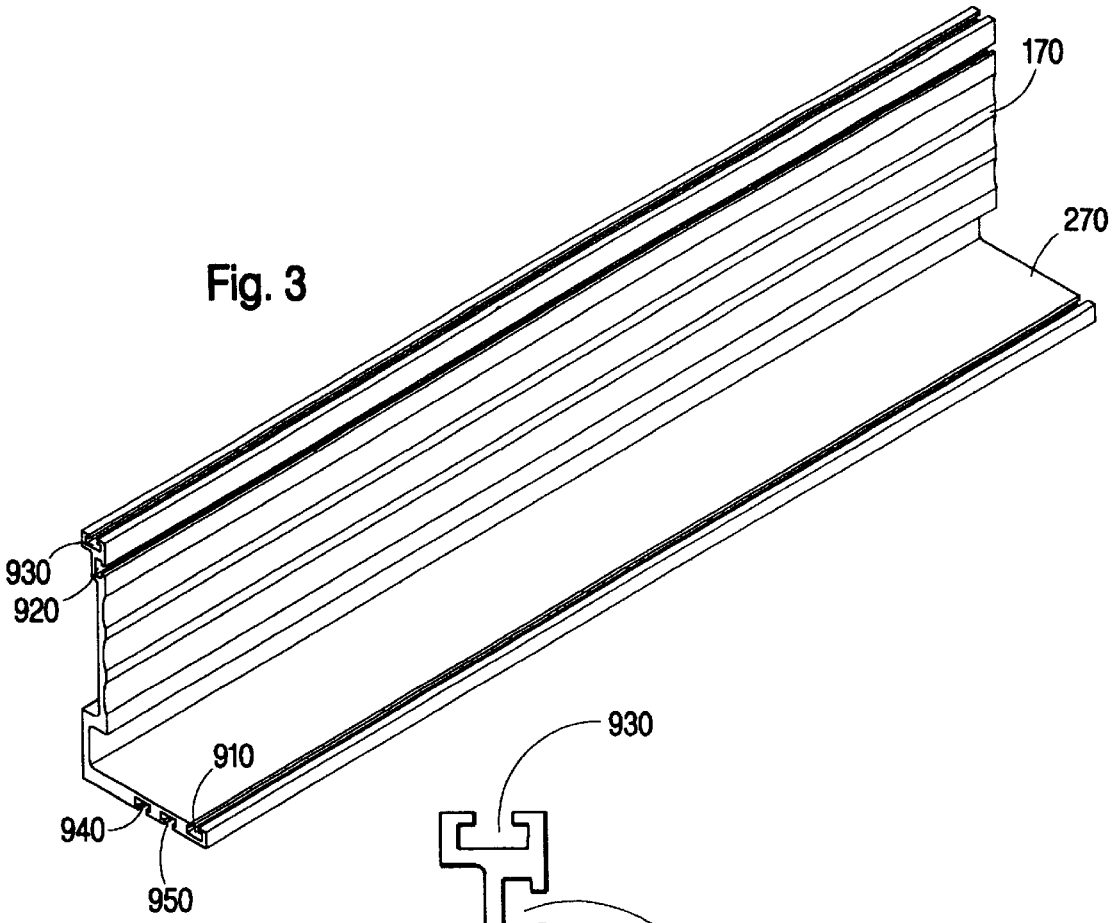
FIG. 3 is an isometric view of a preferred embodiment of the corner jig device of the present invention containing slots along the surfaces of the device for engagement with clamping means.
Figure 4:
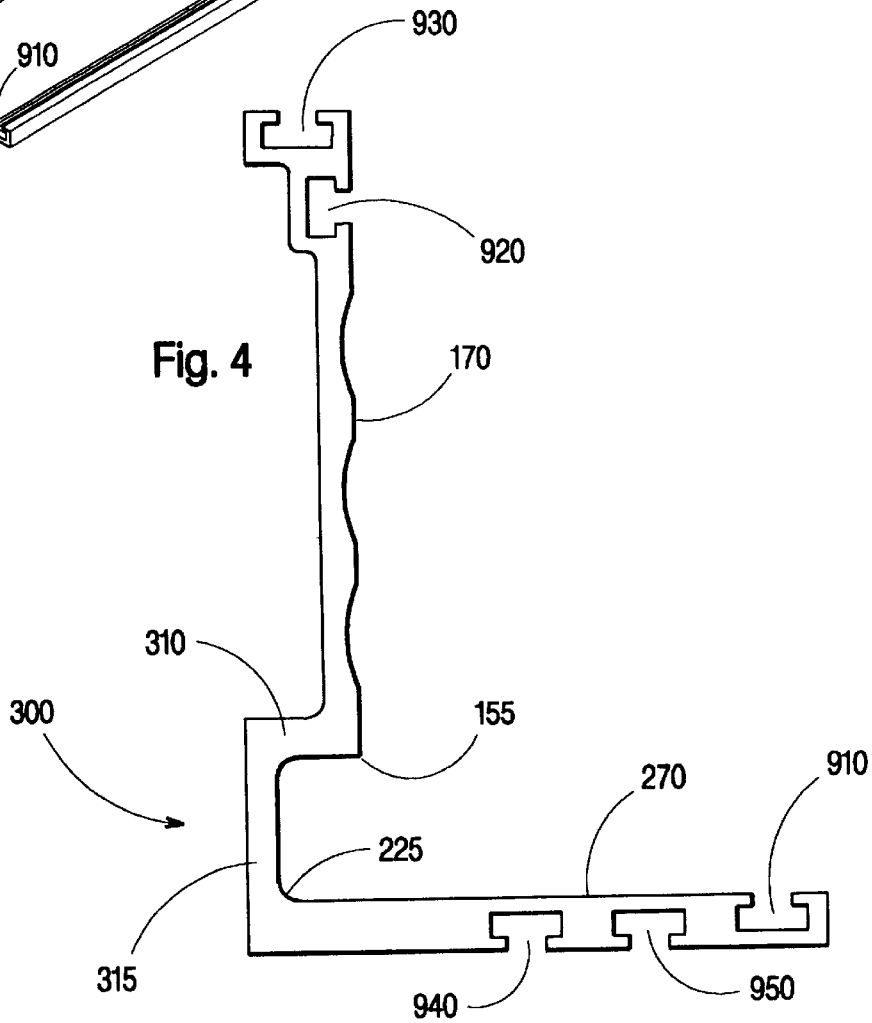
FIG. 4 is an enlarged end view of the preferred embodiment of the corner jig of the present invention containing slots along the surfaces of the device for engagement with clamping means shown in FIG. 3.

FIG. 3 is an isometric view and FIG. 4 is an end view of a preferred embodiment defining the corner jig device 100 of the invention. The preferred embodiment of the jig 100 is generally "L" shaped as before, but in addition, contains slots or channels 910, 920, 930 and 940 and 950 preferably under the jig as shown (collectively "9X0") located along the first and second planar members 125 and 225 as shown, and as can been seen more clearly in FIG. 4. The surfaces 170 and 270 along the first and second planar members 125 and 225 remain in the same planar relationship as seen in connection with the preliminary embodiment shown in FIGS. 1 and 2. Thus, the slots 9X0 do not impair the essential overall flatness of the planar surfaces 170 and 270 in the same manner as the shallow grooves 500 do not impair the flatness of the planar surfaces 170 and 270. The connecting member 300 as shown in FIGS. 1 through 4 is formed of two right angle connecting members 310 and 315, but could be formed of a single curved member 320, see FIG. 4A, of various configurations extending from the lower terminus 155 of the first planar member 125 to the rear terminus 255 of the second planar member 225. Similar to FIGS. 2 and 4 is FIG. 4B which is an end view of an alternative embodiment of the corner jig device 100 of the invention. FIG. 4B is essentially the same as FIG. 4 but without the slots or channels 920, 940 and 950 as shown in FIG. 4. The present inventor has found that certain manufacturing concerns result in difficulty with the introduction of numerous slots into the jig of the invention, and in such a situation where manufacturing concerns become a limiting factor, it would be preferable to have a jig device with either no slots, see FIGS. 1 and 2, or with a minimum number of slots, see FIG. 4B. While the present inventor has shown three different embodiments of the device of the invention in FIG. 2 (no slots), FIG. 4 (multiple slots) and FIG. 4B (two slots), it will be understood that the device of the invention may incorporate any number of combinations or permutations of slot arrangements, each without impairing the planar quality of the planar surfaces 170 and 270 and thus the supportive operability of the device. In fact, the decision to omit slots may make machining the device somewhat easier, while incorporating a plurality of slots may reduce the amount of material used to produce a single device thereby reducing the overall materials production cost.

FIG. 5 is a top view and FIG. 6 is a side view of an embodiment of a fastening implement 600 as it might be seated or housed in one of the slots 9X0, or more particularly for purposes of illustration, slot 910. The fastening implement 600 comprises four basic elements, namely a screw or fastening head 610, a screw threaded stud 620, an elongated cam-action fastener member 630, and a fastening nut 640. The fastener member 630 is oval as shown, although it may be rectangular or square depending on the particular job. The screw or fastening head 610 is contained within the slot 910 and slides within and along the channel defined by the slot 910 by way of movement of the screw threaded stud 620. When the fastening nut 640 is loosened, the fastening implement 600 becomes moveable within the slot 910, or may be introduced or removed from the slot 910, or any other slot 9X0 for that matter. The screw threaded stud 620 is slidable and rotatable within a slot 650 in the cam fastening member 630, such that when the fastening nut 640 is loosened, the cam member 630 may be slid and rotated into position or otherwise positioned against a workpiece (not shown) for maintaining such workpiece in place by a wedging action, thereby assuming the function of a clamp. When the nut 640 is tightened, it compresses the cam fastening member 630 against the surface 270 of the planar member 225, and fixes the position of the cam member 630 on the surface 270, and in position against any workpiece (not shown) positioned adjacent thereto to restrain such workpiece in position on the surface 270. The slots 9X0 are located at various positions along the jig device 100, as indicated at positions 910, 920, 930, 940 and 950, to accommodate a variety of clamping or fastening arrangements, and one skilled in the art will realize that the number or position of the slots 9X0 is variable and determined by the manufacturer and the arrangement of the fastening implements 600 in the slots by the user. Of course, as seen in FIGS. 1 and 2, no slots 9X0 may be present in the jig device 100, and external clamping or fastening implements would then be required to fasten the workpiece (see FIG. 15) to the support surface 170 or 270 of the jig 100.

Figure 7:
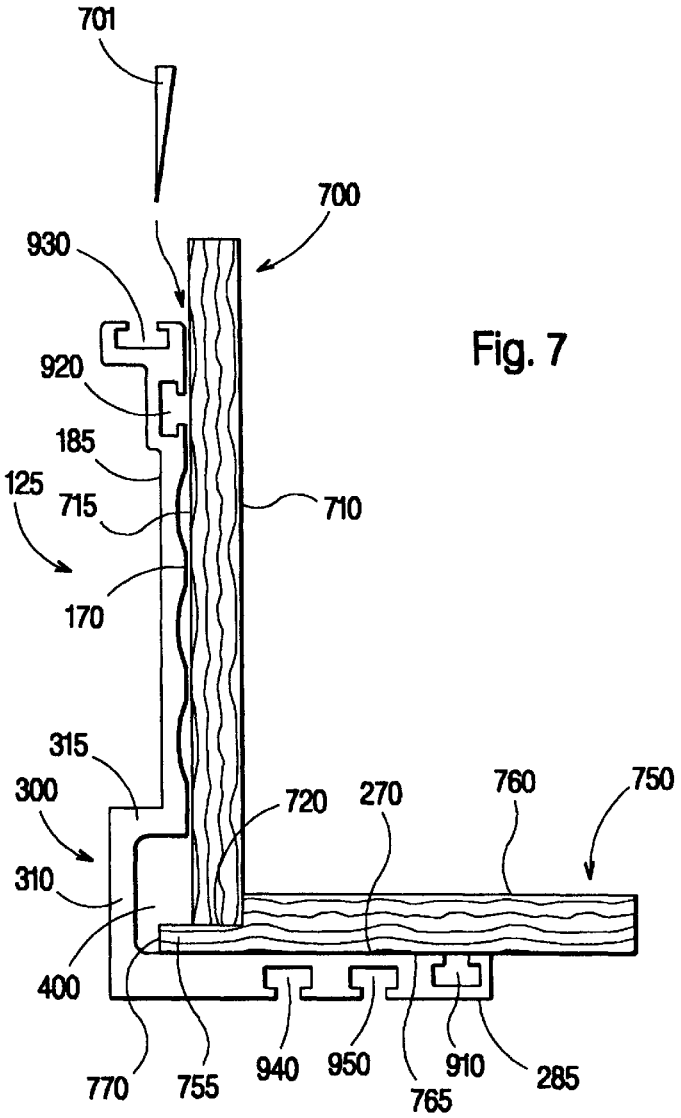
FIG. 7 is a side view of the preferred embodiment of the jig device of the invention showing the placement of a first and second workpiece against the support surfaces of the device of the invention.

FIG. 7 is a side view of the jig device 100 showing the placement of a first and second workpiece 700 and 750 against the support surfaces 170 and 270 of the first and second planar members 125 and 225 respectively. As indicated in the preliminary discussion, a clean corner joint is formed by the placement of the edge 720 of a first workpiece 700 into or against a seat cutout 755 located at the end 770 of a second workpiece 750, such that the end 770 of the second workpiece 750 extends beyond the edge 720 of the first workpiece 700. A normal corner support plate or 90° angle or miter support would not be able to support the joinder of such workpieces 700 and 750 unless the seat 755 of the second workpiece 750 were perfectly dimensioned to receive the edge 720 of the first workpiece, such that a 90° is formed at where the two edges 720 and 770 would meet. The recess 400 of the jig device 100 of the present invention is designed to accommodate the edge 770 of the second workpiece 750 which extends beyond the edge 720 of the first workpiece 700, while the height of the connecting member 300 may be variable in the manufacture of the jig 100, thus varying the dimensions of the recess 400, all depending on the contemplated size of the workpiece. Usually, workpieces which are joined at the corner in this fashion to create a clean corner joint are used mostly in the cabinetry art, and therefore, the workpieces are rarely thicker than one half inch, demanding a fairly nominally sized recess 400. The relationship between the first and second planar members 125 and 225 respectively forming a right or 90° angle assures that the corner joint formed between the workpieces 700 and 750 will also be in the nature of a right or 90° angle. If it should be the case that the first and second planar members 125 and 225, or the first and second surfaces 170 and 270 for that matter, do not form a right angle, then a shim 701 or an equivalent alignment member may be inserted between the workpiece 700 and the first planar member 125, or in between the workpiece 750 and the second planar member 225 as the case may be, to perpendicularly align the workpieces 700 and 750. If a jig 100 of the invention as seen in FIGS. 1 and 2 were utilized without the slots 9X0, then external clamping or fastening implements (not shown here, but see, for example, FIG. 15) would be needed to maintain the two workpieces 700 and 750 in a perpendicular arrangement against the jig 100, and such clamping or fastening implements (not shown) would attach to the outer surface 710 of the first workpiece 700 and the secondary surface 185 of the first planar member 125, as well as to the outer surface 760 of the second workpiece 750 and the secondary support surface 285 of the second planar member 225. Clamping of the first workpiece 700 to the first planar member 125 is fairly effortless, since the jig 100 provides all the necessary flat surfaces upon which to place the clamp. Clamping of the second workpiece 750 to the second planar member 225 is not as effortless, since the secondary support surface 285 will be inaccessible if the jig 100 were placed on a planar surface such as the floor, table or ground (all not shown). Of course, external clamping or fastening implements could be used with the jig 100 of FIGS. 3, 4, 4A and 4B, since all of the support surfaces remain basically unchanged regarding planar support.

Figure 8:
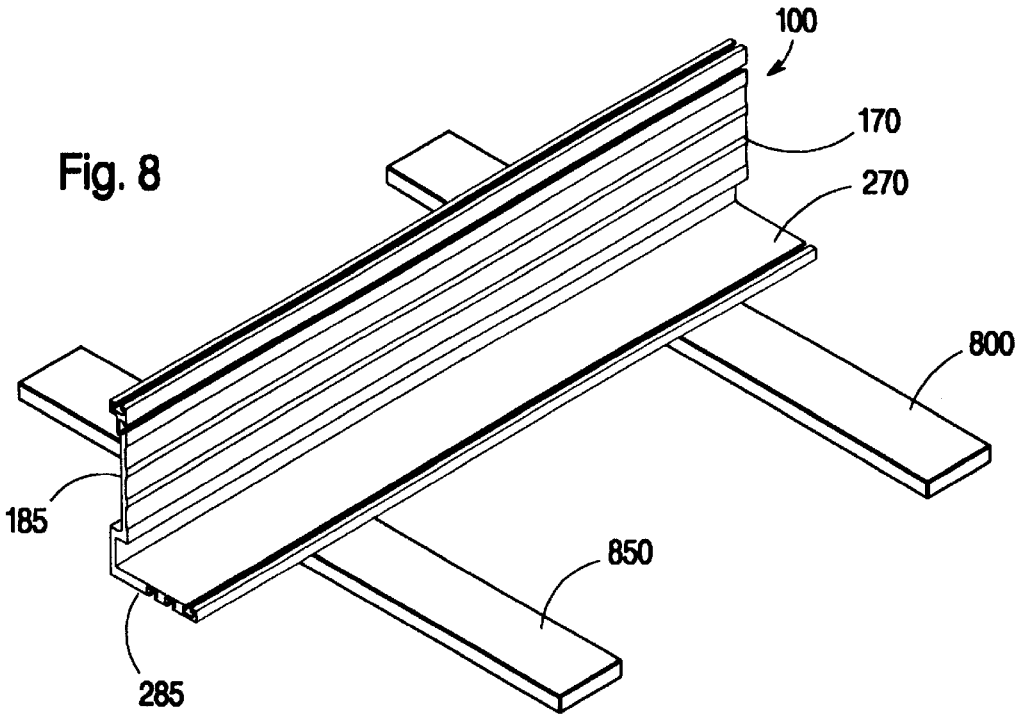
FIG. 8 is an isometric view of the jig of the present invention seated on two elevating members.
Figure 9:
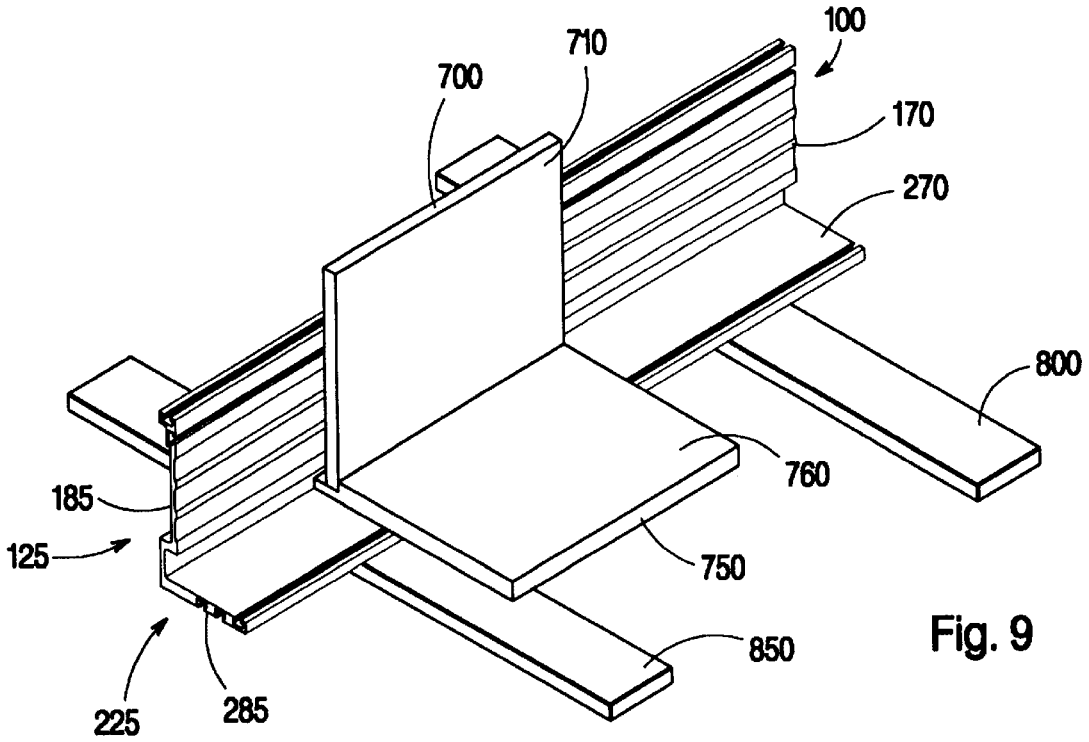
FIG. 9 is an isometric view of jig of the present invention raised up on elevating members with two workpieces located on the planar surfaces of the device of the invention.

The present inventor, realizing a need to maximize the amount of access to all support surfaces of his jig 100, especially the secondary support surface 285 which would be inaccessible if the jig 100 were placed on a planar surface, preferably provides for elevation of his jig 100 to gain access to such support surface 285 and to further facilitate all clamping and fastening operations. FIG. 8 is an isometric view of the jig 100 of the present invention seated on two elevating members 800 and 850, which elevating members 800 and 850 are preferably two by four pieces of wood, chosen for their ease and convenience in obtaining. FIG. 9 is an isometric view of jig 100 raised up on elevating members 800 and 850, with the workpieces 700 and 750 located on the planar surfaces 170 and 270 as shown (see also FIG. 7). The elevating members 800 and 850 allow any external clamping or fastening means (not shown here, but see, for example, FIG. 15) to fasten the second workpiece 750 to the second planar member 225 by easily accessing both the exposed surface 760 of the second workpiece 750 and the secondary support surface 285 of the second planar member 285. As shown in FIG. 9, clamps or other external fastening means (not shown) may be attached to both the jig 100 and the workpieces 700 and 750 in any number of places in order to maintain the perpendicular alignment of the workpieces 710 and 760 with each other during the fastening together of the workpieces. Other elevating means such as small feet or preferably retractable feet on the bottom of the device could be used, but the ubiquitous two by four timbers are completely satisfactory, simple and most convenient in most cases.

Figure 10:
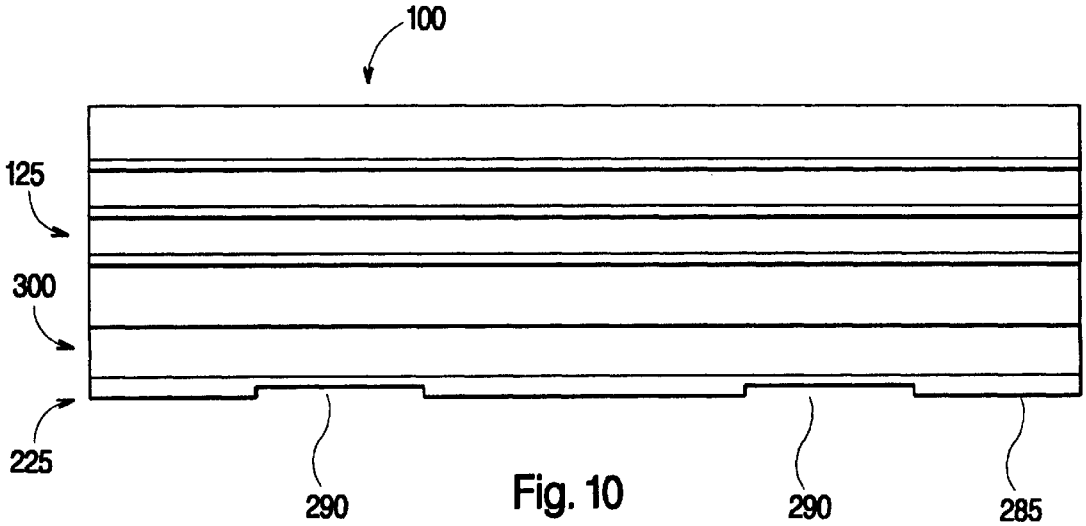
FIG. 10 is a front view of an alternative embodiment of the jig device of the invention containing transverse channels extending along the entire secondary support surface of the device of the invention.

Both FIGS. 8 and 9 illustrate the jig 100 on the elevating members 800 and 850, where the only surface of the jig 100 that is in contact with the elevating members 800 and 850 is the secondary support surface 285 of the second planar member 225. The transverse dimension of the second planar member 255 is extensive enough to adequately support the jig 100 upon the elevating members 800 and 850, and such support is aided by the planar quality of the secondary support surface 285. FIG. 10 is a front view of an alternative embodiment of the jig 100 of the invention illustrating transverse channels 290 extending across the entire secondary support surface 285 of the jig 100, such channels 290 dimensioned to receive conventionally sized elevating members 800 and 850, such as, for example, nominally-dimensioned two by four timbers or similar sized pieces of wood. The channels 290 provide greater stability of the jig 100 on such elevating members, and constrain the jig 100 to the actual transverse location of the channels. It is preferred in most cases that the jig 100 does not contain the channels 290, since varying the transverse placement of the jig 100 upon the elevating members 800 and 850 may be desirable, and movement of such jig 100 upon the elevating members 800 and 850 once the jig is being used to aid in the fastening process is not likely to mistakenly occur. Another alternative embodiment not shown in the drawings would be to incorporate elevating members directly into the body of the jig structure, i.e. to have "feet"-like elevating members extending from the secondary support surface 285 of the second planar member 225 in place of the channels 290 shown in FIG. 10, such that access to all support surfaces is achieved in a manner similar to that with the use of elevating members 800 and 850. As noted above, such feet-like elevating members may be desirably retractable or removable. Of course, the elevating members 800 and 850 shown in FIGS. 8 and 9 may not necessarily resemble rectangular pieces of wood as shown, since they may be almost anything, such as a plurality of jars, a table, a separate stand, etc. which effectively raises the jig 100 in order to gain access to the secondary support surface 285.

Alternative fastening embodiments are shown in FIGS. 10A and 10B which depict edge views of the device of the invention 100 fastenably supported to a table 292 or the like using a conventional fastener 294 such as a screw, bolt, nail or the like. In FIG. 10A, the fastener connection 294 between the jig 100 and the table 292 occurs near the front terminus 240 of the jig 100 of the invention, while in FIG. 10B the fastener connection 294 between the jig 100 and the table 292 occurs near the upper terminus 140 of the jig 100 of the invention. In FIG. 10B, the jig 100 of the invention is positioned such that the connecting member 300 extends downwardly unsupported by the surface of the table 292. For obvious reasons, the jig 100 of the invention oriented as shown in FIG. 10B may not be placed in the same orientation on a planar surface because doing so would sacrifice the horizontal alignment of the surface 170 and similarly the vertical alignment of the surface 270. FIGS. 10A and 10B also illustrate orifices 303 through 306, orifice 303 and 306 similarly located in the connecting member 300 of FIGS. 10A and 10B, orifices 304 and 305 similarly located in the planar member 225 of FIGS. 10A and 10B, which may serve as avenues or passageways for fastening members (not shown) to be inserted into the junction of two workpieces (not shown) positioned on the first and second surfaces 170 and 270 in a fastening arrangement. Referring back to FIG. 7 for illustration, an orifice positioned in the second planar member 225 through the asterisk "*" would provide an avenue for the insertion of an additional fastener (not shown) through the edge 720 formed between the shown workpieces 700 and 750. While such orifices may create additional workpiece fastening possibilities, they do not impair the integrity or the level of the supporting surfaces 170 and 270 similar to the way the grooves 500 or slots 9X0 do not impair the integrity of the supporting surfaces 170 and 270.

Figure 11:
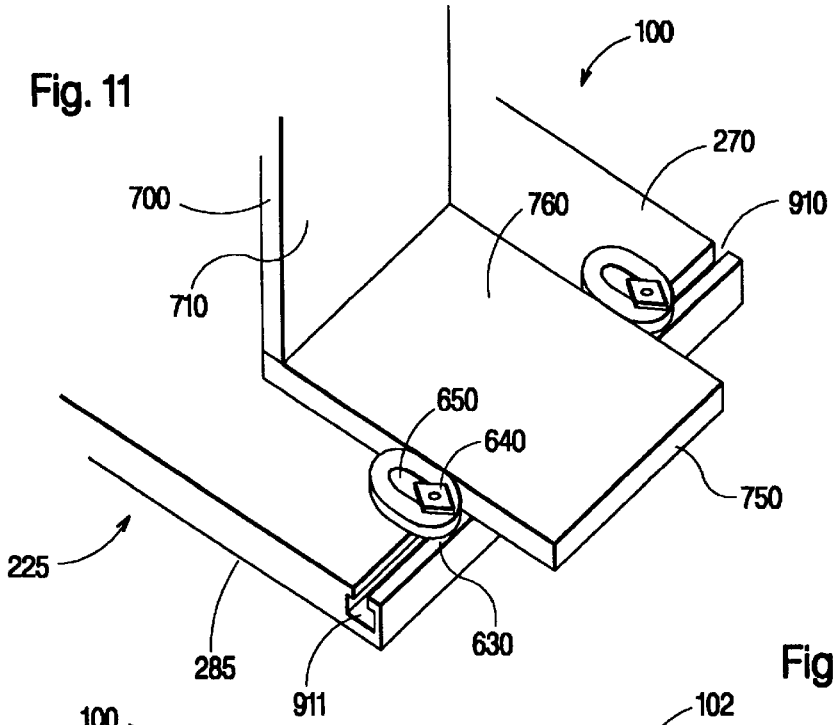
FIG. 11 is a partial isometric view of the lower central portion of the jig assembly displayed in FIG. 9, with the omission of the elevating members, and illustrating the use of slot-positioned fastening implements against the workpiece.

FIG. 11 is a partial isometric view of the lower central portion of the jig assembly displayed in FIG. 9, but with the jig 100 not raised on any elevating members 800 and 850 so that the secondary support surface 285 is not accessible to any external clamping or fastening means. FIG. 11 illustrates the use of integrated fastening implements 600, previously shown and described in FIGS. 5 and 6, against the workpiece 750. The workpiece 760 is initially placed upon the primary support surface 270 of the second planar member 225. The screw or fastening head 610 (not shown) is placed within the opening 911 of the slot 910 and the fastening implements 600 are moved along the slot 910 until the cam member 630 from each fastening element 600 comes in contact with the side edges of the workpiece 750. The cam member 630 is then rotated and moved within slot 650 until each cam member 630 acting upon the workpiece 750 creates a tight grip therebetween. The nuts 640 of the fastening elements 600 are then tightened fixing the cam members 630 into place against the workpiece 750 as shown. The same type of fastening arrangement (not shown) is implemented along the upper side edges of the vertically-oriented workpiece 700, possibly utilizing slots 920 or 930 (not shown) thereby fastening the workpiece 700 against the first planar member 125 (not shown), and thus, maintaining the two workpieces 700 and 750 in a perpendicular arrangement in order to facilitate the glue bond between such workpieces 700 and 750.

The fastening implements 600, demonstrated in FIG. 11, which are fastenable to the jig surfaces 170 and 270 through the various slotted channels 9X0 provide for a variety of fastening and pseudo-clamping options. Referring back to FIG. 7, the slots 910 and 920 provide parallel fastening of a workpiece to the surfaces 270 and 170 respectively. Any number of fastening implements 600 may be used. A fastening implement 600 located along slot or channel 930 may provide a compressive fastening surface that extends beyond and perpendicular to the surface 170 of the first planar member 125, thereby creating a fastening surface that is parallel to the surface 270 of the second planar member 270, thus acting to compress any workpiece or workpieces between the fastening implement and the surface 270.

Figure 11A:
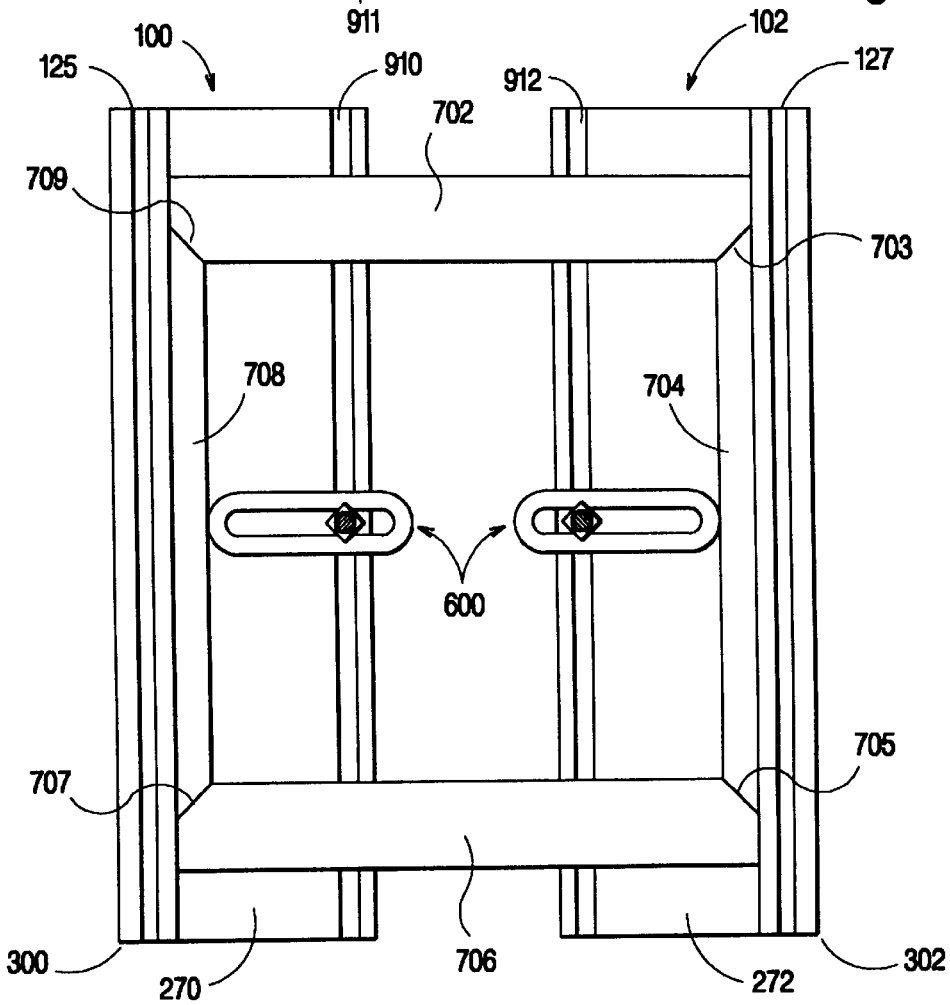
FIG. 11A is a top view of a plurality of opposite-facing jigs of the invention, shown with a face-frame workpiece assembly supported therebetween.

FIG. 11A is a top view illustrating an alternative use of the device of the present invention showing the use of fastening implements. A frame consisting of workpieces 702, 704, 706 and 708 is initially dowel-connected and placed between a pair of oppositely-oriented jigs 100 and 102 on their respective support surfaces 270 and 272. The alignment of the jigs 100 and 102 provides a perfect square-frame surface for the connection and fastening of the frame workpieces thereby preventing any of such workpieces from becoming misaligned at their abutting edge surfaces or corners 703, 705, 707 and 709. Fastening implements 600 situated within slots 910 and 912 as shown may be used to force the workpieces 704 and 708 against the connecting members 300 and 302 of the jigs 100 and 102 to further align and support the workpieces during the fastening stage. Additional "C"-type clamps (see FIG. 15) may be used between the workpiece surfaces 702, 704, 706 and 708 and/or their abutting edges 703, 705, 707 and 709 to maintain the workpieces against the support surfaces 270 and 272 as such workpieces are being fastenably connected. For obvious reasons, when using the jig device of the invention as shown in FIG. 11A, it is preferable to have two jigs 100 and 102 positioned in an oppositely-oriented manner as shown to create a square, perpendicular environment for maintenance of the workpieces during their While the fastening implements 600 of FIGS. 5 and 6 are generally two-dimensional in nature, such fastening implements 600, in particular the cam member 630 of the fastening implements 600, may take the form of a "L" shape, see FIG. 12, where such an "L"-shaped fastener 630L is shown, such that the fastening implements 600 provided in slots 940 and 950 might extend perpendicular to the second planar member 225 beyond the primary support surface 270, and would require the elevation of the jig 100 to accommodate such fastening implement 600, such as those described and shown in FIGS. 8 and 9. The "L" shaped embodiment of the cam fastener 630L allows such cam fastener 630L to extend from underneath the jig 100 and provide vertical support to any workpiece which might extend tangentially to the edge of the second planar member 225, and, when such embodiment is used in combination with another fastening implement 600 (not shown) on the opposite side of the slots 940 and 950, such combination of fastening implements 600 would provide a pair of vertical supports to maintain a workpiece in either a fastening relationship with another workpiece, or to maintain a workpiece on the primary support surface 270 of the second planar member 225. Complementary slots of the nature exhibited by slots 940 and 950 may also be located and integrated into the first planar member 125, and function in a similar manner as such slots 940 and 950. Similarly, an "L" shaped cam fastener 630L (not shown) may also be employed within, for example, slot 930 along the upper terminus 140 of the first substantially planar member 125, such that the cam fastener 630L extends from the upper terminus 140 toward the lower terminus 155 to provide downwardly directed vertical support to any workpiece which might be supported against either the primary support surface 170 or against the primary support surface 270. If such fastening implement 600 were placed along the upper terminus 140 of the device of the invention, the length of the cam fastener 630L could be variable such that the fastener 630L could clamp the upper edge of a workpiece that is supported along the primary surface 170 or the exposed surface of a workpiece that is supported along the primary surface 270. Consequently, a variably-positionable cam fastener 630L could accommodate and fastenably position and reinforce workpieces of varying sizes and positions. Other embodiments of the invention would be to have slots at various places along the surfaces 170 and 270, not just where shown in FIGS. 2 and 4, such that a large number of possible clamping and fastening arrangements may be implemented with respect to any workpiece that is placed on the jig 100.

Figure 13:
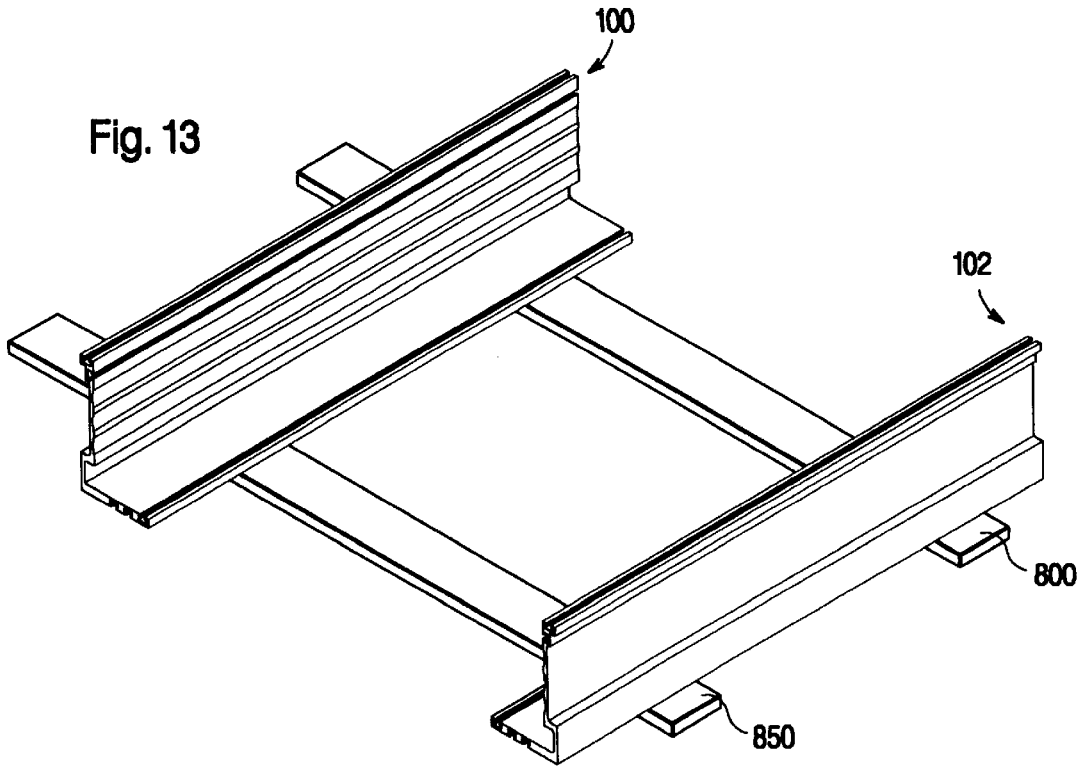
FIG. 13 is an isometric view of a plurality or pair of opposite-facing jigs of the invention seated upon elevating members to illustrate one particular usage of the device of the invention.
Figure 14:
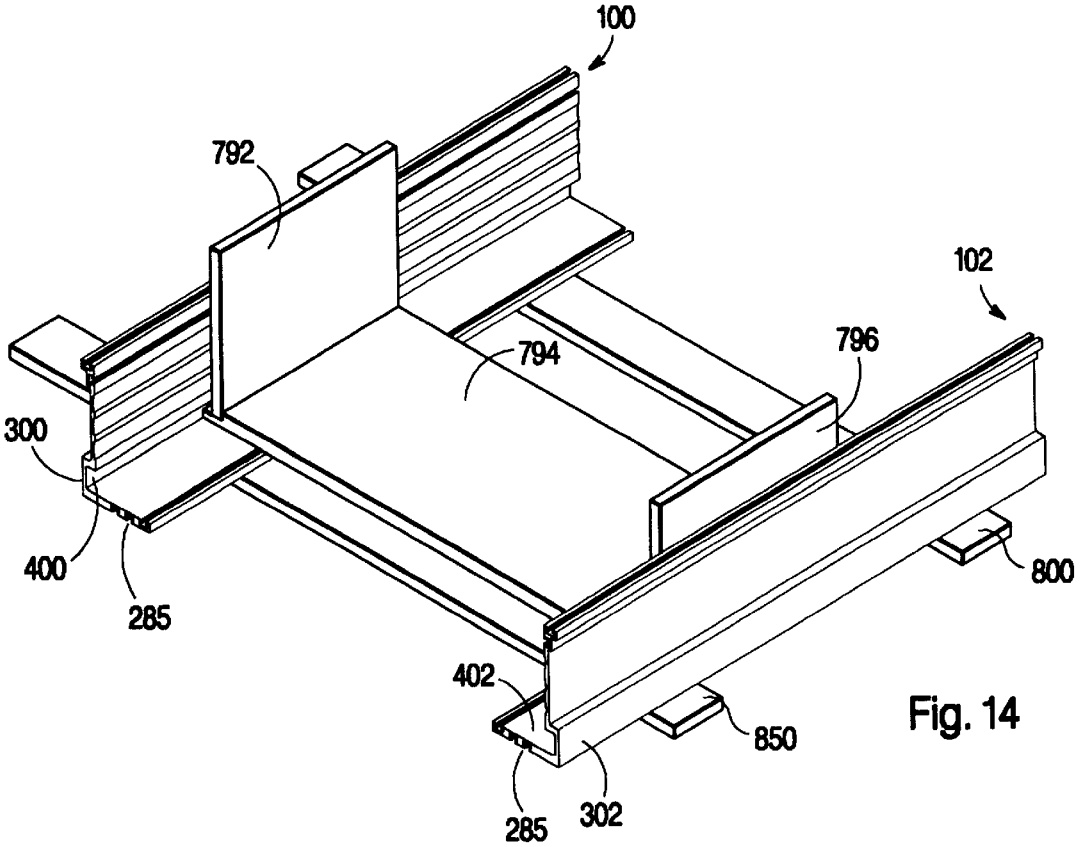
FIG. 14 is an isometric view of a plurality or pair of opposite-facing jigs of the invention, shown with a workpiece assembly supported therebetween.

FIG. 13 is an isometric view of a plurality of opposite-facing jigs 100 and 102 seated upon elevating members 800 and 850. This particular arrangement of jigs 100 and 102 may operate to effectively clamp a workpiece assembly 790 as shown in FIG. 14. The jig 100 of the invention is versatile enough that it may be used in a variety of ways, such as, for example, in a side by side arrangement to meet the supporting need of an unusually long piece, not necessarily limited to what is shown in FIGS. 9 (single jig) and 14 (oppositely facing jigs). See, for example, FIG. 11A. FIG. 14 displays a workpiece assembly 790 comprised of two vertically supported workpieces 792 and 796 in a fastening arrangement with a horizontally supported workpiece 794, all supported between two oppositely facing jigs 100 and 102. The elevating members 800 and 850 allow access to the secondary support surface 285 of each jig 100 and 102 for external clamping or fastening means. In fact, the arrangement of the jigs in support of the workpiece assembly 790 resembles one large clamp assembly. Thus, a large external clamp (not shown) may extend between the connecting members 300 and 302 of each of the jigs 100 and 102 to maintain the workpiece assembly 790 in place during the fastening together of the separate workpieces 792, 794 and 796. Separate clamps (not shown) may also maintain the vertically supported workpieces 792 and 796 in place against the jigs 100 and 102. The assembly shown in FIG. 14 shows the jigs 100 and 102 in use without the utilization of the recess areas 400 and 402, since the horizontal workpiece 794 does not contain a seat 755 with an extended end 770 as shown in FIG. 7, although, of course, if the horizontal workpiece 794 did contain such a seat on either or both ends of such workpiece 794, then the recesses 400 and 402 would, of course, accommodate such extended ends.

Figure 15:
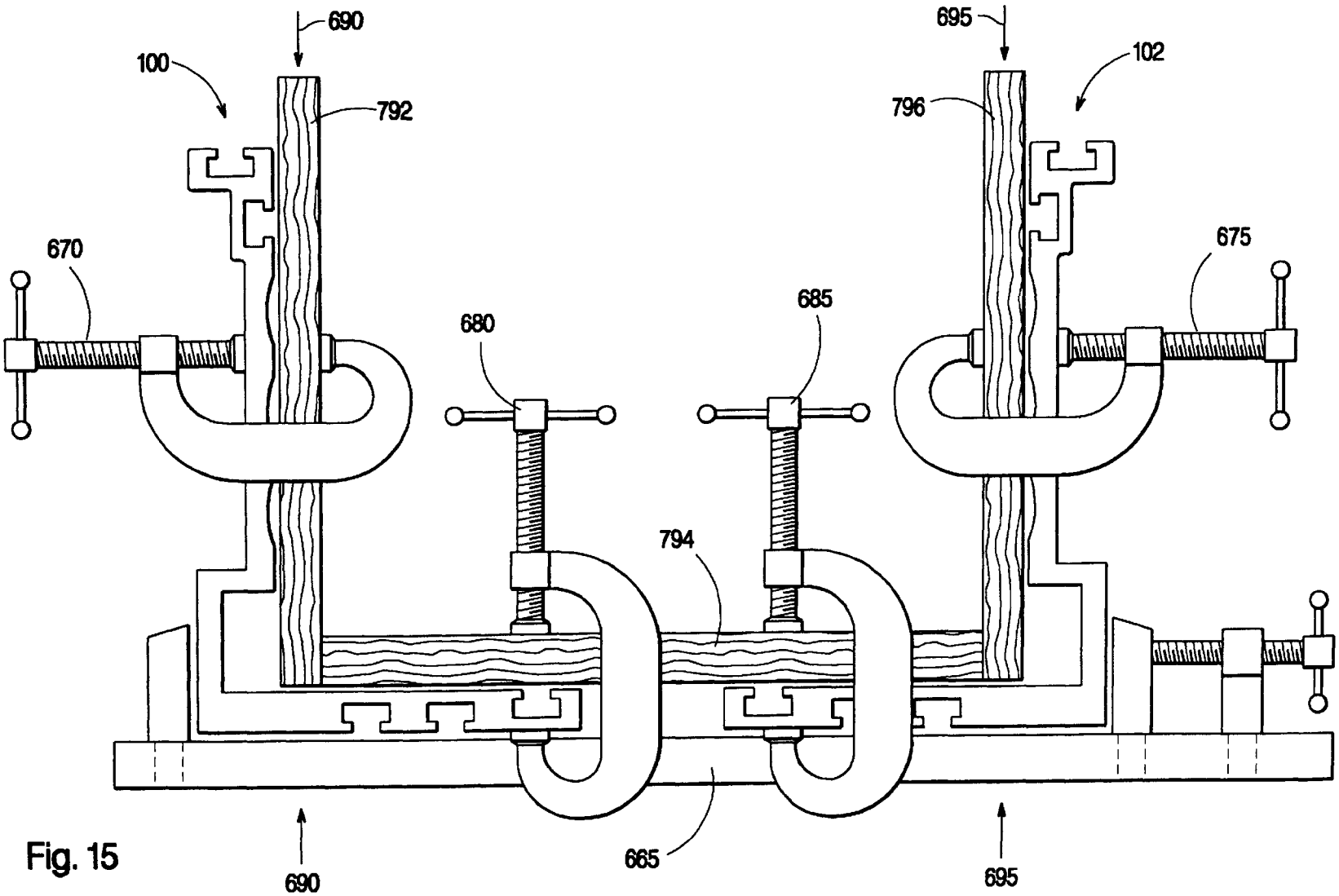
FIG. 15 is an end view of the assembly shown in FIG. 14 with the omission of the elevating members and with the addition of external clamping implements extending between the jigs and positioned between the jigs and the workpieces.

FIG. 15 is an end view of FIG. 14 with the omission of the elevating members 800 and 850 for purposes of better illustrating how the jig members 100 and 102 may be used to securely hold or clamp workpieces 792, 794 and 796 together using expansion clamps 660 in the form of an expansion clamp 665 extending under the jigs 100 and 102 and forcing or biasing them toward each other, plus smaller clamps 670, 675, 680 and 685 which serve to hold the members 792, 794 and 796 against the adjoining jig sections 100 and 102 to form an overall uniformly clamped arrangement. It is well known that expansion clamps 665 of the type depicted in FIG. 15 tend to be unstable if laid unsupported on a planar surface. The present inventor has found that the weight of the jigs of the invention tends to stabilize such expansion clamp members 665 thereby alleviating the need for additional supporting means and reducing the overall number of support structures required to maintain the workpieces and jigs in alignment. While FIG. 15 illustrates the usage of "C" clamps 670 through 685, other compression-type clamps may be used, such as spring clamps, bar clamps, Hanakane clamps, etc. For example, a series of clamps which produce clamping forces depicted by arrows 690 and 695 may also support the workpieces 792 and 796 along their respective vertical planes. Furthermore, expansion clamps 660 allow the workpieces 792, 794 and 796 to remain firmly against the jigs 100 and 102 during the time it takes for the glue to settle between all of the workpieces. A combination of external clamps 660, shown in FIG. 15, and slot-positioned clamps 600, shown in FIGS. 5, 6 and 12, as opposed to merely external clamps 600, or merely slot-positioned clamps 600, may be implemented to form a variety of fastening arrangements. Slot positioned clamps 600 along the second planar member 225 are preferable if access to the secondary support surface 285 of the second planar member 225 is unfeasible. Although, slot-positioned clamps 600 are desirable since any number of such clamps 600 may be transported directly on the jig device of the invention 100, and therefore, there is less of a likelihood that such clamps 600 will be misplaced or go unused. On the other hand, from a slightly different convenience viewpoint, spring clamps would also be desirable, since their method of attachment is quick and efficient, and does not require any twisting or screw tightening. The jig device of the present invention provides a highly desirable foundation for multi-faceted planar fastening operations.

The corner jig 100 of the invention may, as previously described, be used by itself, or in combination with other jigs 102, etc., depending upon the particular fastening and clamping needs of the user. Usage in pairs, preferably opposing pairs, simplifies conventional fastening and gluing of face frames, see FIG. 11A, since the frames stay flat as a result of being clamped to a large, perfectly flat surface. It is preferable that the jig of the invention 100 be anodized, so that it is impervious to rust and will resist sticking from any excess glue that might escape from a glued workpiece joint. Furthermore, the nature of the jig device 100 of the invention having a consistent profile along the length of the device allows the device to be easily extruded from a simple die.

Elevating the corner jig 100 off the floor or off a workbench is usually the first step in successfully using the jig 100 of the invention. However, as discussed and shown in FIGS. 10A and 10B, the jigs may be elevated and fastenably supported to the edge of a table or the like. Elevation using two by fours 800 and 850 is usually the easiest and most convenient, since these items may be found in the workroom of almost any respectable woodworker. The elevating members 800 and 850 are usually placed in a parallel arrangement and spaced apart along the floor or the workbench, such that the jig device 100 of the invention may be placed upon and transversely supported by such elevating members 800 and 850. Either a single jig 100 is placed upon the elevating members 800 and 850, or if the elevating members 800 and 850 are long enough, and the requirements of the fastening operation so demand, a second jig 102 may be placed in an opposite orientation such that an initial workpiece may span between the pair of jigs 100 and 102.

To prepare a clean corner joint, the workpiece 794 that is initially placed upon the jig 100 parallel to the floor or the workbench is partially cut and glued so that a second workpiece 792 may be positioned against the cut portion of the first workpiece 794 and perpendicular to the first workpiece 794, such that both workpieces 794 and 792 are perpendicularly supported to each other by the jig 100 of the invention. Excess material from the first workpiece 794 extending beyond the edge of the second workpiece 792 at the intersection of the two workpieces 794 and 792 as a result of the formation or creation of the corner joint is accommodated by the recess area 400 of the jig 100 of the invention during the setting of the glue or adhesive. Such excess material is then sanded off when the corner joint is "finished." Once both workpieces 794 and 792 are positioned against the perpendicular foundation surfaces 170 and 270 of the jig 100 of the invention, clamps 660 are preferably applied to each workpiece 794 and 792 between the workpieces 794 and 792 and the jig foundations 100, or more particularly, between the workpieces 794 and 792 and the first and second planar members 125 and 225 of the jig device 100 of the invention, to maintain the workpieces 794 and 792 in a perfect, perpendicular alignment with each other and in a respective perfect, parallel alignment with the support surfaces 170 and 270 of the jig 100 of the invention. Once the glue between the workpieces 794 and 792 has set, the clamping means 660 are removed, and the workpieces 794 and 792 are removed from the jig 100 of the invention. Then the excess material, if any, present during the creation of the corner joint is sanded away or otherwise removed to form a corner joint with the appearance of a continuous grain edge. If desired, additional fastening members may be inserted into the corner joints through orifice passageways or avenues as discussed in FIGS. 10A and 10B.

External clamping means 660, such as "C" clamps or spring clamps, applied to the workpieces 794 and 792 and to the jig 100 of the invention, may be used in conjunction with slot-positioned clamping means 600 as shown in FIG. 11, or such slot-positioned clamping means 600 may be used without external clamping means 660, depending on the user's particular needs and desires. Slot-positioned clamps 600 have the benefit of maintaining a strong fastening hold on the workpiece(s) without the requirement that the jig(s) 100 be elevated off the ground or workbench to accommodate the gripping portion of the external clamping means 660. Also, such slot-based clamps 600 may be semi-permanently positioned directly on the jig 100 within the various slots 900 of the preferred arrangement, see for example, FIGS. 2 and 4, and loosened and subsequently repositioned when desired, without the need to remove the clamps 600 from the slots 900 unless surface space required for the attachment of a workpiece is impaired or reduced, in which case the clamps 600 would be removed to accommodate such workpiece.

The jig of the invention 100 consists of a pair of primary support surfaces 170 and 270 primarily for direct surface engagement with a workpiece or workpieces, and secondary support surfaces 185 and 285 primarily for engagement with external clamping means 660, or, with respect to secondary support surface 285, surface engagement with elevating members and/or the floor and or a workbench top. An tertiary support surface 325 is conveniently utilized for the clamping and fastening of two parallel workpieces, such as, for example, a primary workpiece and a piece of elongate trim to be adhered to such workpiece. The elongated nature of the jig 100 of the invention provides a means whereby effective, planar attachment of workpieces may be accomplished along a variety of support surfaces of the invention, where such workpieces may be oriented both perpendicularly and in parallel.

Figure 16A:
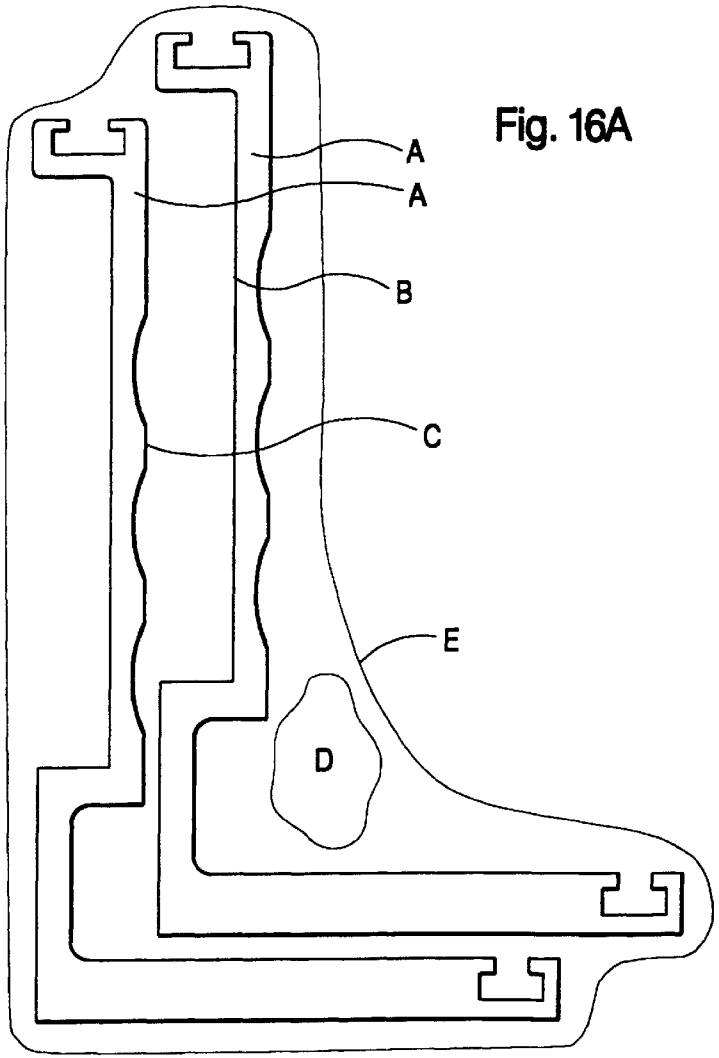
FIG. 16A is a cross sectional end view of a pair of nested jig members of the invention with instruction materials and all assembled in a shrink-wrap type package.
Figure 16B:
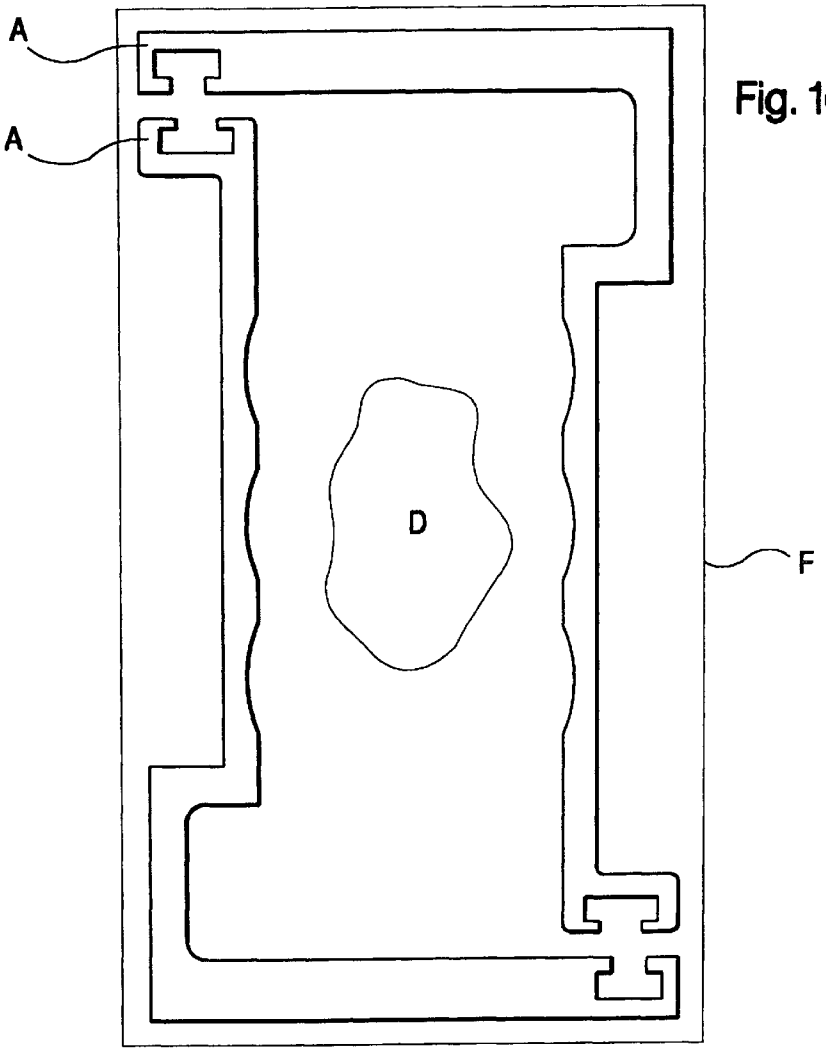
FIG. 16B is a cross sectional end view of a pair of jig members of the invention assembled with their edges together in contact arrangement with instruction materials located between the two jig members of the invention all assembled in a stiff cardboard-type package.

As explained in some detail, while the primary use of the right-angled jig device of the invention is to hold together two corner-joined members in a lap type joint in fine carpentry, the jig members have multiple other uses for holding securely other work pieces such as, for example, dowel-connected frames as shown in FIG. 11A. Consequently, craftsmen will usually desire at least a pair of such jig members along with detailed instructions setting forth how to use them. Consequently, the jig members will usually be sold prepackaged as a pair along with instructions for assembling the members into a suitable assembly for clamping various work pieces into assembly position. FIGS. 16A and 16B show two such packages of pairs of units sold for use in various clamping operations.

FIG. 16A is a cross sectional end view of two of the jig members A and A, nested inside each other back surface B to front surface C, together with instruction materials or means D which, as will be understood may be a sheet providing written and pictorial instructions, a tape or audio disk of oral or verbalized instructions or a video disk or the like with both oral and visual instructions and demonstrations. The actual jig units may be supplied with grooves for use of the clamping means of the preferred forms of the invention as shown in earlier figures, or may be plain and without the slots as shown in FIGS. 1 and 2. The two jig members A and A plus instructional materials D may be effectively held together in a packaged assembly by heavy plastic shrink wrapping E or the like which has the advantage that the contents of the package are clearly visible to potential purchasers. Fastening implements or clamps may, if the necessary slots are provided in the jigs themselves, be packaged in the center of the package with the instructional materials D or may be mounted in any accessible grooves.

FIG. 16B shows another packaging arrangement for an assembly pair of jig members in accordance with the invention. In FIG. 16B, two of the jig members A and A are assembled with their edges preferably together in contact arrangement instruction means or materials D preferably placed in the rectangular central opening between the two jig members A and A, and with a sturdy rectangular cardboard box F or the like covering the entire contents. In this arrangement, the clamp members can easily be provided in the center with or as part of the instructional materials D as shown.

As will be understood from the foregoing explanation and description, use of the jig device and assembly of the invention provides skilled craftsmen as well as others with an aid by which they can accomplish easily with little possibility of error carpentry or cabinetry operations which were before relatively difficult and sometimes almost impossible except by the very skilled.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A specially extended jig means comprising:

a. a first substantially planar member with an upper terminus, a lower terminus, and a primary support surface, b. a second substantially planar member with a front terminus, a rear terminus, an upper primary support surface and a lower secondary support surface, c. the second planar member being oriented substantially perpendicular to the first planar member and displaced therefrom, and d. a connecting member extending between the lower terminus of the first planar member and the rear terminus of the second planar member and defining a tertiary support surface adjacent the first planar member and substantially parallel to the second planar member, e. the rear terminus of the second planar member extending beyond the plane defined by the first planar member such that a recess is defined between the first and second planar members and bounded by the connecting member.

2. A jig in accordance with claim 1 wherein the connecting member extended between the first and second planar members is substantially rectangular.

3. A jig in accordance with claim 1 wherein the connecting member is other than rectangular.

4. A jig in accordance with claim 1 wherein the recess extends substantially to the side of the first planar member by reason of a separate extension from the end of the first planar member interconnecting with the connecting member.

5. A jig in accordance with claim 4 additionally comprising slots in the outer surfaces of the first and second planar members adapted for interengagement with sections of clamps.

6. A jig in accordance with claim 5 additionally comprising clamping means having interengaging ends engaged with the slots.

7. A jig assembly in accordance with claim 6 wherein there are two substantially identical jigs adapted for combined use included within packaging for such jigs.

8. A jig for accurately aligning elongated surfaces between members being permanently secured together comprising:

a. a first member laterally extended along a first plane having a substantially planar alignment surface and a thickness substantially less than the lateral extension of said first member, b. a second member laterally extended along a second plane perpendicular to the extension of the first plane having a substantially planar alignment surface disposed generally perpendicularly to the planar alignment surface of the first member and facing generally toward the first member and having a thickness substantially less than the lateral extension of such second member, c. an edge of said first member being disposed toward the planar alignment surface of the second member and spaced therefrom, d. a connecting member securing the first and second members together, e. said connecting member being displaced to the side of the edge of the first member, f. the edge of the first member, a portion of the alignment surface of the second member and the inside of the connecting member forming an extended chamber between the first and second members.

9. A jig in accordance with claim 8 wherein the extended chamber between the first and second members is substantially rectangular.

10. A jig in accordance with claim 8 wherein the extended chamber is other than rectangular.

11. A jig in accordance with claim 8 wherein the extended chamber extends substantially to the side of the first member by reason of a separate extension from the end of the first member interconnecting with the connecting member.

12. A jig in accordance with claim 11 additionally comprising slots in the outer surfaces of the first and second members adapted for interengagement with sections of clamps.

13. A jig in accordance with claim 12 additionally comprising clamping means having interengaging ends engaged with the slots.

14. A jig assembly in accordance with claim 11 wherein there are two substantially identical jigs adapted for combined use included within packaging for such jigs.

15. A specially extended jig means comprising:

a. a first substantially planar member with an upper terminus, a lower terminus, and a primary support surface, b. a second substantially planar member with a front terminus, a rear terminus, an upper primary support surface and a lower secondary support surface, c. the second planar member being oriented substantially perpendicular to the first planar member and displaced therefrom, d. a connecting member extending between the lower terminus of the first planar member and the rear terminus of the second planar member and defining a tertiary support surface adjacent the first planar member and substantially parallel to the second planar member, e. the rear terminus of the second planar member extending beyond the plane defined by the first planar member such that a recess is defined between the first and second planar members and bounded by the connecting member, and f. longitudinal surface slots situated along at least the first planar member for interengagement with slot-positioned fixation means.

16. A jig in accordance with claim 15 wherein the fixation means further comprises a rotatable cam-fastening member for fastening engagement with a workpiece to be supported against the jig of the invention.

17. A method of positioning and supporting a plurality of planar workpieces in a fastenable arrangement comprising:

a. placing a support, the support comprising a horizontally-oriented surface, a vertically-oriented surface, and a connecting means separating the two surfaces and defining a recess area therebetween, on a structural foundation in preparation to receive the workpieces, b. placing a first work piece against the horizontally-oriented surface of the support, c. placing a second workpiece against the vertically-oriented surface of the support, in direct interengagement with and perpendicular to the first workpiece, such that any excess material from the first workpiece extending beyond the second workpiece at the interengagement between the first and second workpieces will be accommodated by the recess area, d. maintaining the two workpieces in a fastenable arrangement on the support until the workpieces are satisfactorily fastened together, e. removing the workpieces from the support, and f. finishing off the joint created between the first and second workpieces.

18. The method in accordance with claim 17 wherein the workpieces are maintained in a fastenable arrangement on the support using clamping means between the workpieces and the surfaces of the support.

19. The method in accordance with claim 18 additionally comprising:

g. initially elevating the support such that the clamping means may extend between the workpiece and the underside of the horizontally-oriented support surface.

20. The method in accordance with claim 18 additionally comprising:

g. placing a second, oppositely oriented support, such that the first workpiece extends between and is supported on the horizontally-oriented surfaces of the two supports, h. placing a third workpiece against the vertically-oriented surface of the second support, in direct interengagement with and perpendicular to the opposite end of the first workpiece, such that two corner joints may be formed at opposite ends of the first workpiece.

* * * * *